US011957234B2

(12) United States Patent
Petty

(10) Patent No.: US 11,957,234 B2
(45) Date of Patent: Apr. 16, 2024

(54) FLEXIBLE STRUCTURE FOR COLLAPSIBLE FLASKS AND BOTTLES

(71) Applicant: Jon A. Petty, St. George, UT (US)

(72) Inventor: Jon A. Petty, St. George, UT (US)

( * ) Notice: Subject to any disclaimer, the term of this patent is extended or adjusted under 35 U.S.C. 154(b) by 0 days.

(21) Appl. No.: 17/717,051

(22) Filed: Apr. 9, 2022

(65) Prior Publication Data

US 2022/0322813 A1 Oct. 13, 2022

Related U.S. Application Data

(60) Provisional application No. 63/173,582, filed on Apr. 12, 2021.

(51) Int. Cl.
*B65D 33/02* (2006.01)
*A45F 3/20* (2006.01)

(52) U.S. Cl.
CPC ..... *A45F 3/20* (2013.01); *A45F 2003/205* (2013.01); *B65D 33/02* (2013.01)

(58) Field of Classification Search
CPC ..... A45F 2003/166; A45F 2003/205; A45F 3/20; A47G 23/0258; B65D 33/02; B65D 33/007; B65D 33/165; B65D 35/28; B65D 57/00; B65D 61/00; B65D 75/008; B65D 77/06
USPC ..... 135/121, 126, 128, 138, 132; 220/23.91, 220/9.1, 9.2, 9.3, 9.4; 222/214, 92, 173, 222/105, 183, 100, 175; 248/95, 99, 104, 248/105, 107; 383/104, 119, 12; 141/390, 316; 206/218
See application file for complete search history.

(56) References Cited

U.S. PATENT DOCUMENTS 1,086,002 A * 2/1914 Stewart ..... B65B 67/1205 141/390
1,180,574 A * 4/1916 Despot ..... B65D 37/00 220/9.3
1,402,355 A * 1/1922 Henderson ..... D06F 53/005 383/41
1,787,060 A * 12/1930 Wolf ..... B65D 35/56 222/105
1,865,645 A 7/1932 Schroder
(Continued)

FOREIGN PATENT DOCUMENTS

DE 4243678 A1 6/1994
JP H11342948 A 12/1999

OTHER PUBLICATIONS

International Search Report and Written Opinion dated Aug. 1, 2022 for corresponding PCT Application No. PCT/US2022/024160.

*Primary Examiner* — Gideon R Weinerth
(74) *Attorney, Agent, or Firm* — David Meibos; Maywood IP Law

(57) ABSTRACT

A flexible structure may be configured to expand a collapsible flask. The flexible structure may include a first loop made of an elastically flexible material and a second loop made of an elastically flexible material. The first loop and the second loop may be operatively coupled together at a first intersection and a second intersection. The first loop and the second loop, together, may be elastically movable between a compressed configuration in which the first loop and the second loop are sufficiently narrow to fit through an opening of the collapsible flask, and an expanded configuration in which the first loop and the second loop are not sufficiently narrow to fit through the opening.

22 Claims, 12 Drawing Sheets

(56) References Cited

U.S. PATENT DOCUMENTS 2,182,932 A * 12/1939 Sanford ..... B65D 57/00 229/199
2,518,145 A * 8/1950 Jenson ..... B67D 3/00 222/386.5
2,529,565 A * 11/1950 Mills ..... A43D 3/1416 223/77
2,908,463 A * 10/1959 Chenette ..... G09F 1/08 248/95
3,161,326 A * 12/1964 Parr ..... A47G 23/0258 222/105
3,238,984 A * 3/1966 Shurtleff ..... A45F 3/20 222/107
4,550,848 A * 11/1985 Sucato ..... A45F 3/16 229/120.07
4,637,934 A * 1/1987 White ..... A61J 9/006 426/123
4,690,357 A * 9/1987 Webster ..... B65B 67/12 D34/5
4,825,892 A * 5/1989 Norman ..... E04H 15/40 135/905
4,978,025 A * 12/1990 Fougeres ..... B65D 31/12 222/173
4,985,721 A * 1/1991 Moon ..... G03D 17/00 190/127
5,022,767 A * 6/1991 Cardulla ..... B65D 33/02 220/9.3
5,102,076 A * 4/1992 North ..... A47L 19/00 211/DIG. 1
5,183,169 A 2/1993 Grzych
5,249,592 A * 10/1993 Springer ..... E04H 15/40 135/905
5,421,542 A * 6/1995 Crutcher ..... F26B 25/18 D32/58
5,439,017 A * 8/1995 Brown ..... E04H 15/40 135/132
5,678,731 A * 10/1997 Okamura ..... B65D 35/28 222/391
7,552,734 B2 * 6/2009 Adams ..... A45F 3/20 450/38
7,886,459 B2 * 2/2011 Ruess ..... F26B 21/008 34/106
8,992,084 B2 * 3/2015 Pellingra ..... B65D 33/12 383/906
9,211,987 B2 * 12/2015 James ..... B65D 47/305
9,321,558 B2 * 4/2016 Callahan ..... B65D 33/02
9,821,284 B2 * 11/2017 Johns ..... B01F 35/32021
D930,306 S * 9/2021 Wang ..... B65D 37/00 D32/37
2005/0029290 A1 * 2/2005 Lee ..... B65D 75/008 222/92
2007/0047851 A1 * 3/2007 Sato ..... B29C 66/3452 383/906
2008/0193057 A1 * 8/2008 Nomura ..... B29C 66/53263 383/119
2012/0085782 A1 * 4/2012 Futori ..... B65D 75/008 222/105
2013/0129260 A1 * 5/2013 Pellingra ..... B65B 1/02 383/33
2014/0014789 A1 * 1/2014 Verma ..... B65D 33/02 248/99
2014/0119676 A1 * 5/2014 Martin ..... B65D 75/56 383/7
2014/0254959 A1 * 9/2014 Peck ..... A45C 7/0077 383/107
2014/0314342 A1 * 10/2014 Verma ..... B65D 33/007 383/34
2015/0122842 A1 * 5/2015 Berg, Jr. ..... B65D 75/008 222/173
2015/0353254 A1 * 12/2015 Pauly ..... B65D 25/465 222/105
2017/0367510 A1 * 12/2017 Robinson ..... B65D 47/06
2018/0148228 A1 * 5/2018 Bray ..... B65D 31/12
2018/0170622 A1 * 6/2018 Pellingra ..... B65D 33/1616
2019/0039820 A1 * 2/2019 Hansley ..... B01F 35/32021
2020/0231353 A1 * 7/2020 Van Den Hoonaard ..... B65D 75/008
2021/0120928 A1 * 4/2021 Dona ..... A45C 11/04
2022/0322813 A1 * 10/2022 Petty ..... A45F 3/20

* cited by examiner

FLEXIBLE STRUCTURE FOR COLLAPSIBLE FLASKS AND BOTTLES

CROSS-REFERENCE TO RELATED APPLICATIONS

The present application claims the benefit of U.S. Provisional Application Ser. No. 63/173,582, entitled FLEXIBLE STRUCTURE FOR COLLAPSIBLE FLASKS AND BOTTLES, which was filed on Apr. 12, 2021. The foregoing application is incorporated by reference as though set forth herein in its entirety.

TECHNICAL FIELD

The present disclosure relates to a flexible structure for soft, pliable flasks. More particularly, the present disclosure relates to a flexible structure that may be inserted into a flask or placed externally to add rigidity.

BACKGROUND

There are many runners throughout the world. Some of these runners may be professionals, while others may run for exercise or as a hobby. One thing that all runners have in common is that they need to stay hydrated. As runners begin to sweat, the likelihood of dehydration increases. Dehydration occurs when a runner loses more fluid, typically through sweating, than is taken into the body. Dehydration may not only lead to serious health conditions but will also have a major effect on running performance. When less fluid is in a runner's body, less oxygen rich blood will be transported to the muscles, thereby increasing fatigue and decreasing the running pace.

The remedy for dehydration is simply to drink more water. However, many runners may not carry water while they are running due to the burden of carrying the weight of water bottles. Accordingly, companies have sought to address this issue by creating collapsible water bottles, which are lightweight and easily packed away when water is removed. Even with the benefits of collapsible bottles, they still have shortcomings. For example, runners often utilize a running vest or belt and clothing pockets where they attempt to store collapsible flasks and/or bottles. However, the collapsible flasks are almost impossible to insert when fluid is removed, and rigidity of the collapsible flask is reduced. One attempted solution is to fill the flask with air by blowing into it then re-inserting it into a pocket. This, however, may be hazardous if done during a run when respiration is necessary for providing oxygen to the runner's body. In addition, air may not add sufficient rigidity to the flask due to the compressibility of gases and may not prevent the flask from folding during insertion to a pocket.

Accordingly, there is a need for a structure that can add rigidity to collapsible bottles and flasks so that a user may easily insert them into a running vest or belt, clothing pockets, etc. The present disclosure seeks to solve these and other problems.

SUMMARY

The various systems and methods of the present disclosure have been developed in response to the present state of the art, and, in response to the problems and needs in the art that have not yet been fully solved by currently available in connection with collapsible flasks and bottles. The systems and methods of the present disclosure may provide for a flexible structure to be placed in an interior or outside on an external surface of a collapsible flask or bottle to increase the rigidity of the collapsible flask or bottle.

To achieve the foregoing, and in accordance with the disclosure as embodied and broadly described herein, a flexible structure for collapsible flasks and bottles may include a first loop made of an elastically flexible material and a second loop made of an elastically flexible material. In an embodiment, the first loop and the second loop may be operatively coupled together at a first intersection and a second intersection. The first loop and the second loop, together, may be elastically movable between a compressed configuration in which the first loop and the second loop are sufficiently narrow to fit through an opening of the collapsible flask, and an expanded configuration in which the first loop and the second loop are not sufficiently narrow to fit through the opening, in an embodiment.

In one embodiment, a flexible structure for collapsible flasks and bottles may include a first loop and a second loop. The first loop and second loop may be coupled to each other at a first intersection and a second intersection. The first and second loops may be elliptically shaped in an embodiment. In an embodiment, a first end of the flexible structure may comprise a first ring coupled thereto. The first ring may be perpendicular and coupled to the first loop and the second loop. The first ring may contact a bottom of a flask or bottle. In addition, the flexible structure may comprise a second ring at an end opposite the first ring. The second ring may be interposed between the first and the second loop, similar to the first ring. The second ring may comprise a first side and a second side separated by a first gap and a second gap. It will be appreciated that the first and second gaps allow the second ring to expand around the flask and be positioned on a neck of the flask. The flexible structure may comprise a pliable material (e.g., plastic) that may be flexible so that it may expand around the flask or bottle. In an embodiment, the flexible structure may include a clip formed on the first ring to secure a collapsible flask to the first ring.

In an embodiment, a flexible structure may be positioned around an outside neck of a flask (between a lid and the flask neck). The flexible structure may extend to a bottom of the flask and couple thereto so as to add some rigidity to the flask. In some embodiments, a hook or clip may be used to couple the flexible structure to the bottom of the flask.

In an embodiment, the flexible structure may include a tether that includes a first end mechanically coupled to the flexible structure and a second end mechanically coupled to the flexible structure. In an embodiment, the first end of the tether may be coupled to the flexible structure at a first tether connection socket formed at the first intersection of the first loop and the second loop and the second end of the tether is coupled to the flexible structure at a second tether connection socket formed at the second intersection of the first loop and the second loop. In an embodiment, the tether may further include a first tether joint formed at the first end of the tether, the first tether joint including a first joint well; a first locking wall formed on a first side of the first joint well, the first locking wall having an oval shape; and a second locking wall formed on a second side of the first joint well. The first locking wall interfaces with a first tether connection socket formed at a first intersection of the first loop and the second loop to allow the first locking wall to pass through the first tether connection socket when the tether is in a first orientation and lock the tether against the first intersection when the tether is in a second orientation. In an embodiment, the tether may further include a second tether joint formed at the second end of the tether, the second tether joint including a second joint well; a first locking wall formed on a first side of the second joint well, the first locking wall having an oval shape; and a second locking wall formed on a second side of the second joint well. Again, the first locking wall interfaces with a second tether connection socket formed at a second intersection of the first loop and the second loop to allow the first locking wall to pass through the second tether connection socket when the tether is in a first orientation and lock the tether against the second intersection when the tether is in a second orientation.

These and other features and advantages of the present disclosure will become more fully apparent from the following description and appended claims, or may be learned by the practice of the disclosure as set forth hereinafter.

BRIEF DESCRIPTION OF THE DRAWINGS

Exemplary embodiments of the disclosure will become more fully apparent from the following description and appended claims, taken in conjunction with the accompanying drawings. Understanding that these drawings depict only exemplary embodiments and are, therefore, not to be considered limiting of the disclosure's scope, the exemplary embodiments of the disclosure will be described with additional specificity and detail through use of the accompanying drawings in which:

DETAILED DESCRIPTION

Figure 1:
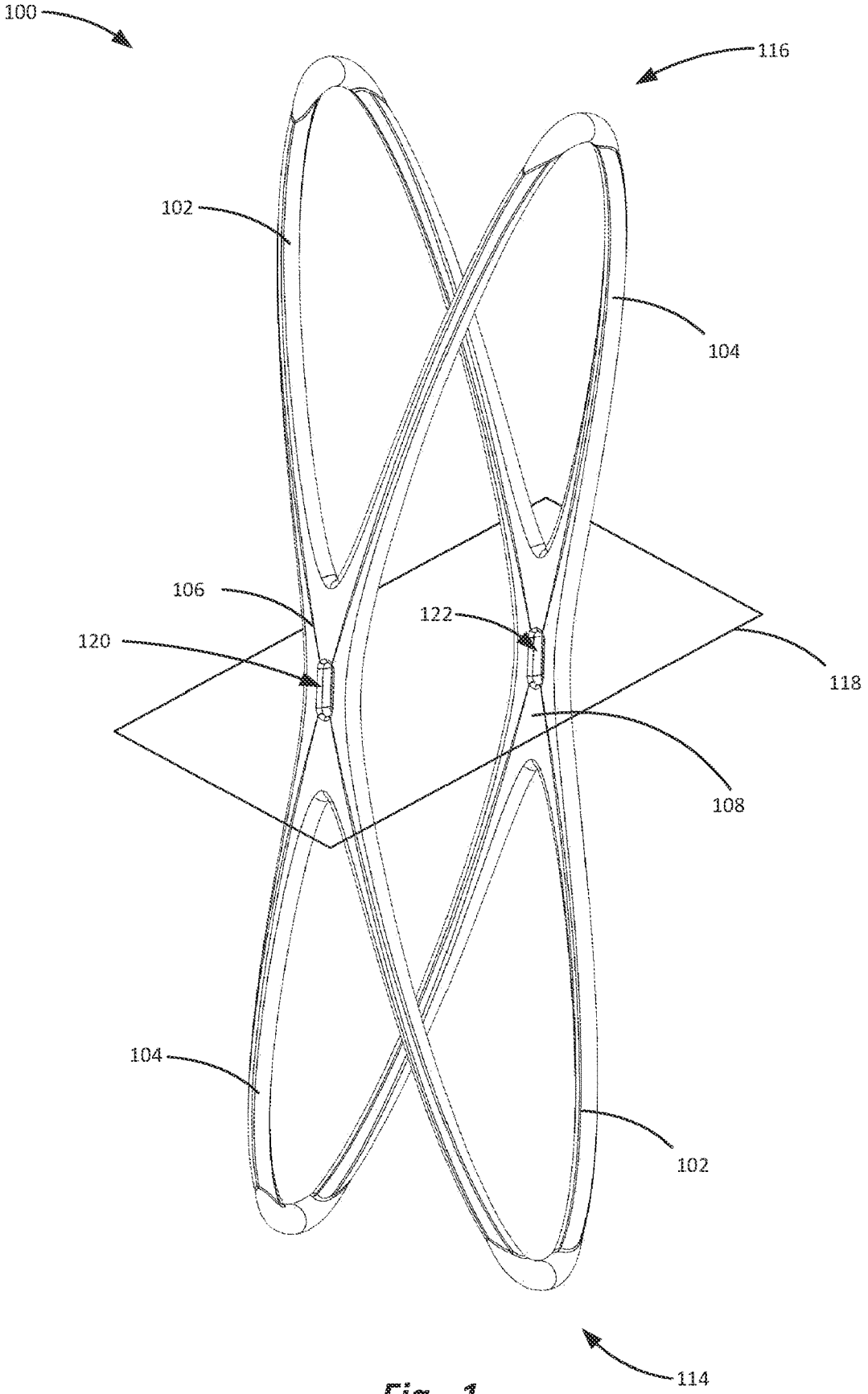
FIG. 1 is a perspective view of a flexible structure according to one embodiment.

Exemplary embodiments of the disclosure will be best understood by reference to the drawings, wherein like parts are designated by like numerals throughout. It will be readily understood that the components of the disclosure, as generally described and illustrated in the Figures herein, could be arranged and designed in a wide variety of different configurations. Thus, the following more detailed description of the embodiments of the apparatus, system, and method, as represented in FIGS. 1 through 12, is not intended to limit the scope of the disclosure, as claimed, but is merely representative exemplary of exemplary embodiments of the disclosure.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The term "abutting" refers to items that are in direct physical contact with each other, although the items may not necessarily be attached together. The phrase "fluid communication" refers to two features that are connected such that a fluid within one feature is able to pass into the other feature.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

As discussed earlier, there is a need for a structure that can add rigidity to collapsible bottles and flasks so that a user may easily insert them into a running vest or belt, clothing pockets, etc. The present disclosure seeks to solve these and other problems.

Even with the benefits of collapsible bottles, they still have shortcomings. For example, runners often utilize a running vest or belt and clothing pockets where they attempt to store collapsible flasks and/or bottles, but they are almost impossible to insert when some fluid is removed, and rigidity is reduced. Often the collapsible bottle will fold onto itself, making it incapable of being positioned in a loose or tight pocket. One attempted solution to add rigidity to the flask was to fill the flask with air by blowing into it then re-inserting into the pocket. However, this may be hazardous if doing it during a run. In addition, air does not add much rigidity to the flask, thereby a user may still have difficulty when inserting the flask into a pocket.

The flexible structure described herein comprises a first loop and a second loop that are coupled together. The flexible structure may be inserted into different sizes and shapes of collapsible flasks in an exemplary embodiment. In another embodiment, the flexible structure may be coupled to an outer surface of a collapsible flask. It will be appreciated that the flexible structure may be used to expand a collapsible flask thereby adding a level of rigidity to the collapsible flask to allow a user to place it in a pocket and not have it deform. It will further be appreciated that the flexible structure may be easily inserted and removed from the flask depending on whether the user needs a rigid or collapsible flask or bottle.

Figure 2:
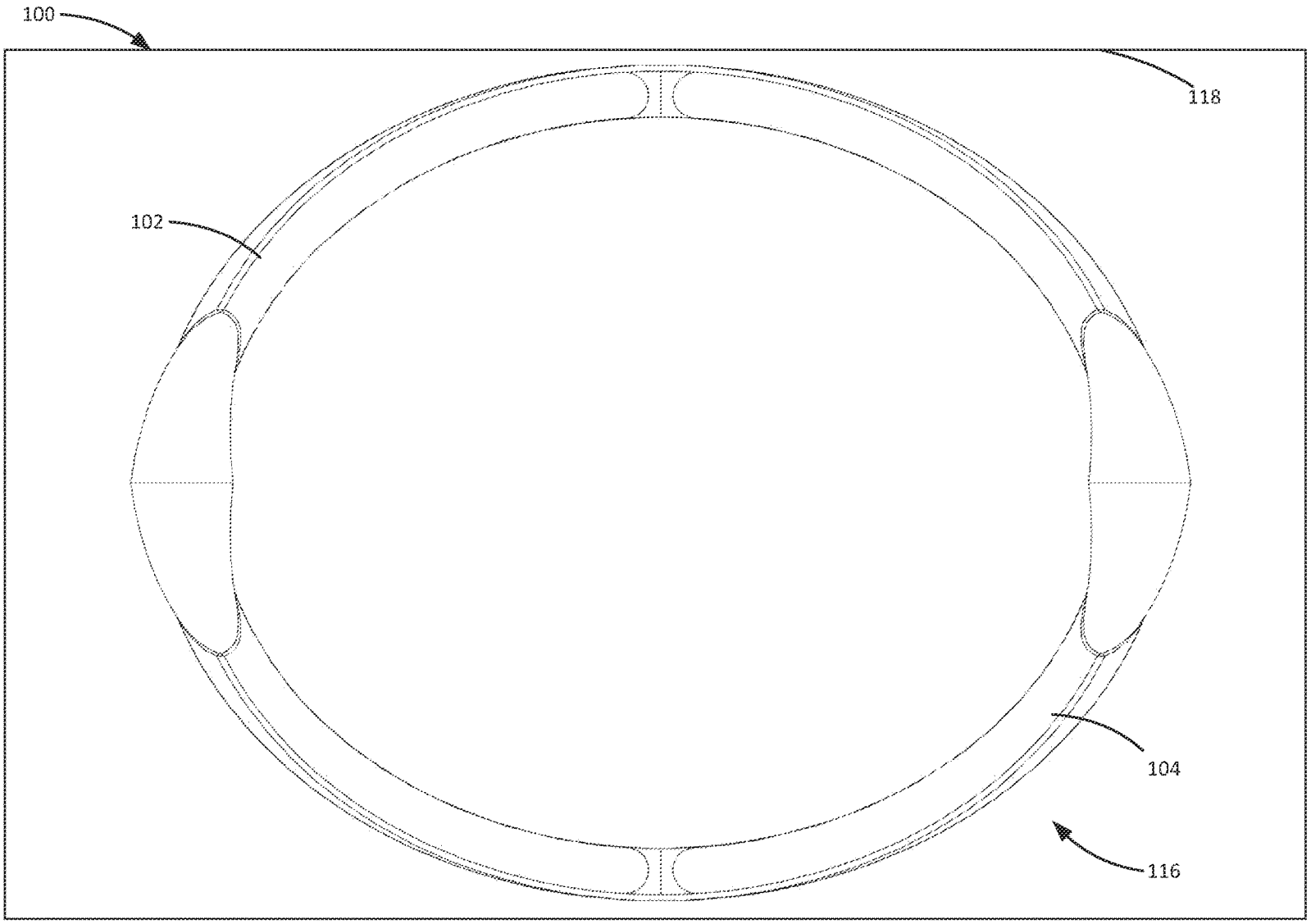
FIG. 2 is a top, plan view of a flexible structure according to one embodiment.
Figure 3:
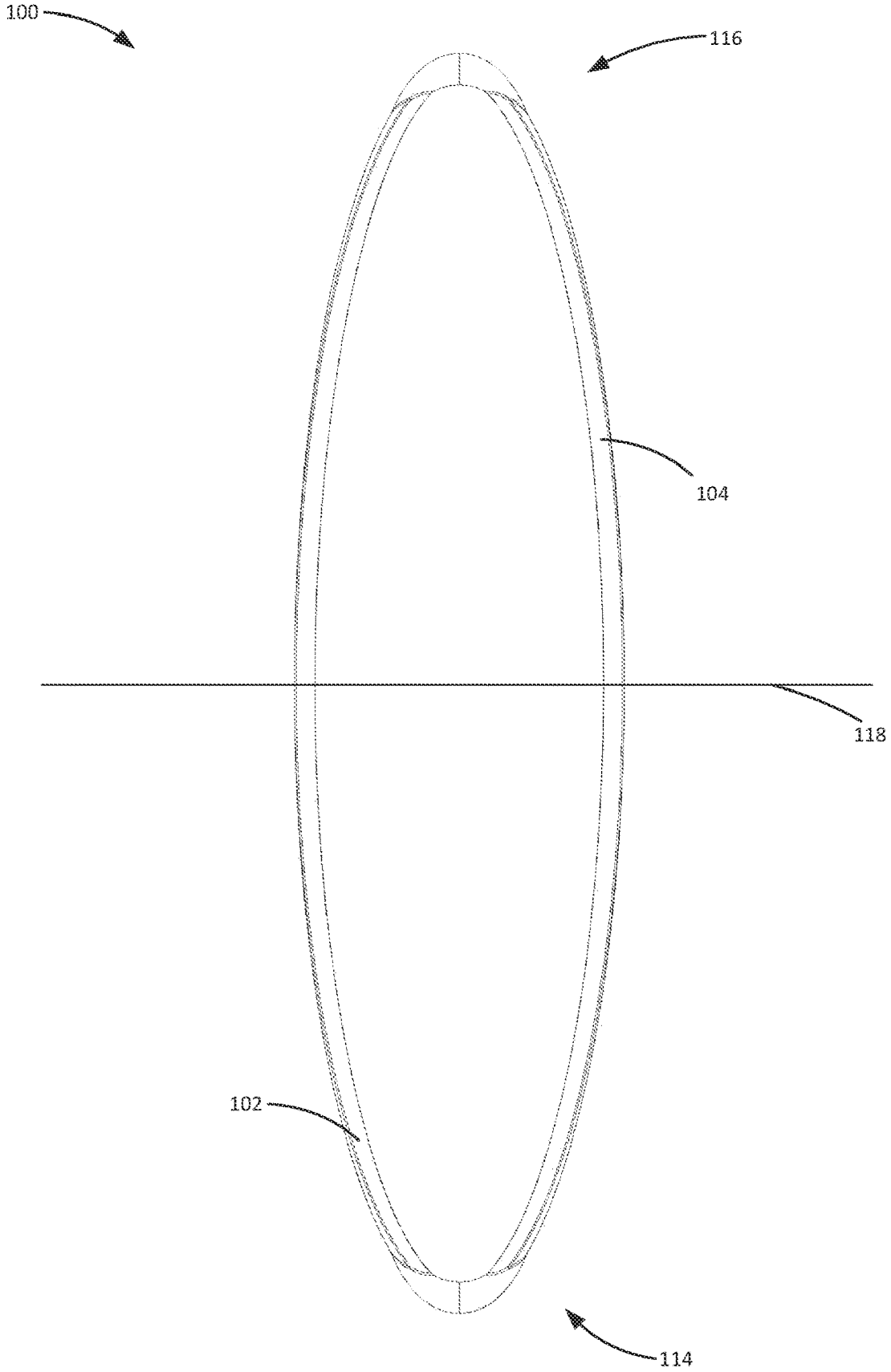
FIG. 3 is a side, elevation view of a flexible structure according to one embodiment.
Figure 4:
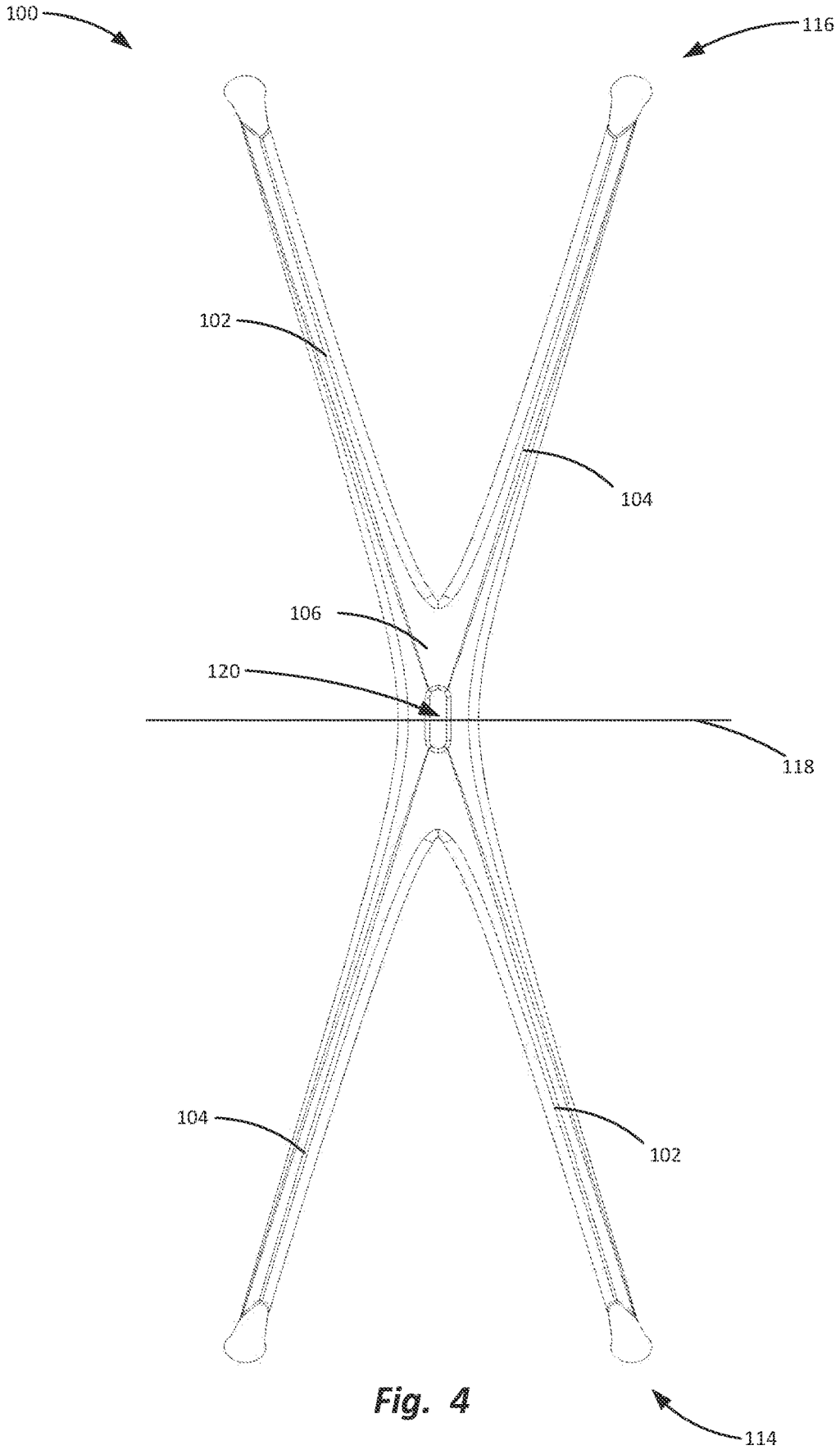
FIG. 4 is a front, elevation view of a flexible structure according to one embodiment.
Figure 5:
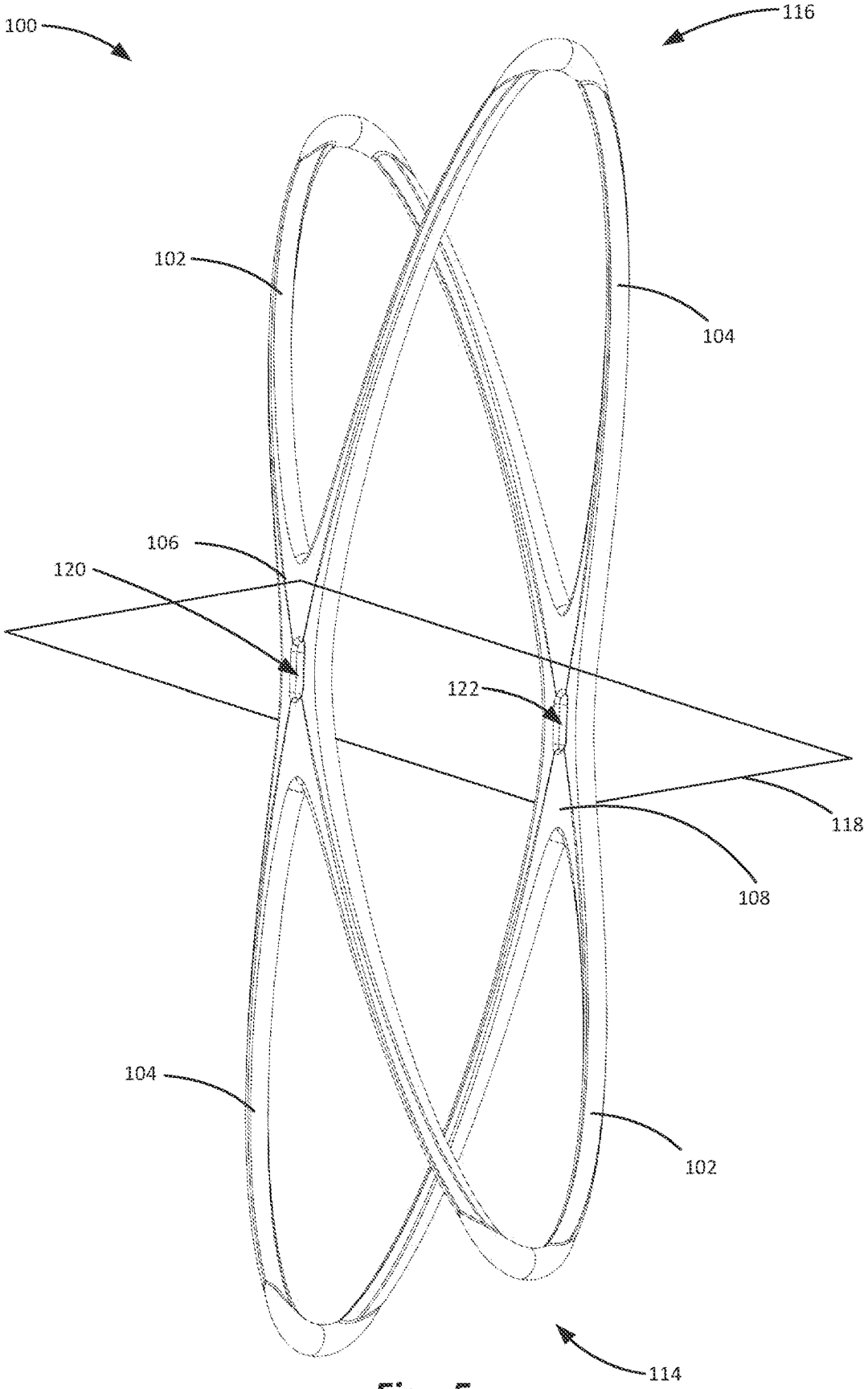
FIG. 5 is a bottom, perspective view of a flexible structure according to one embodiment.
Figure 6:
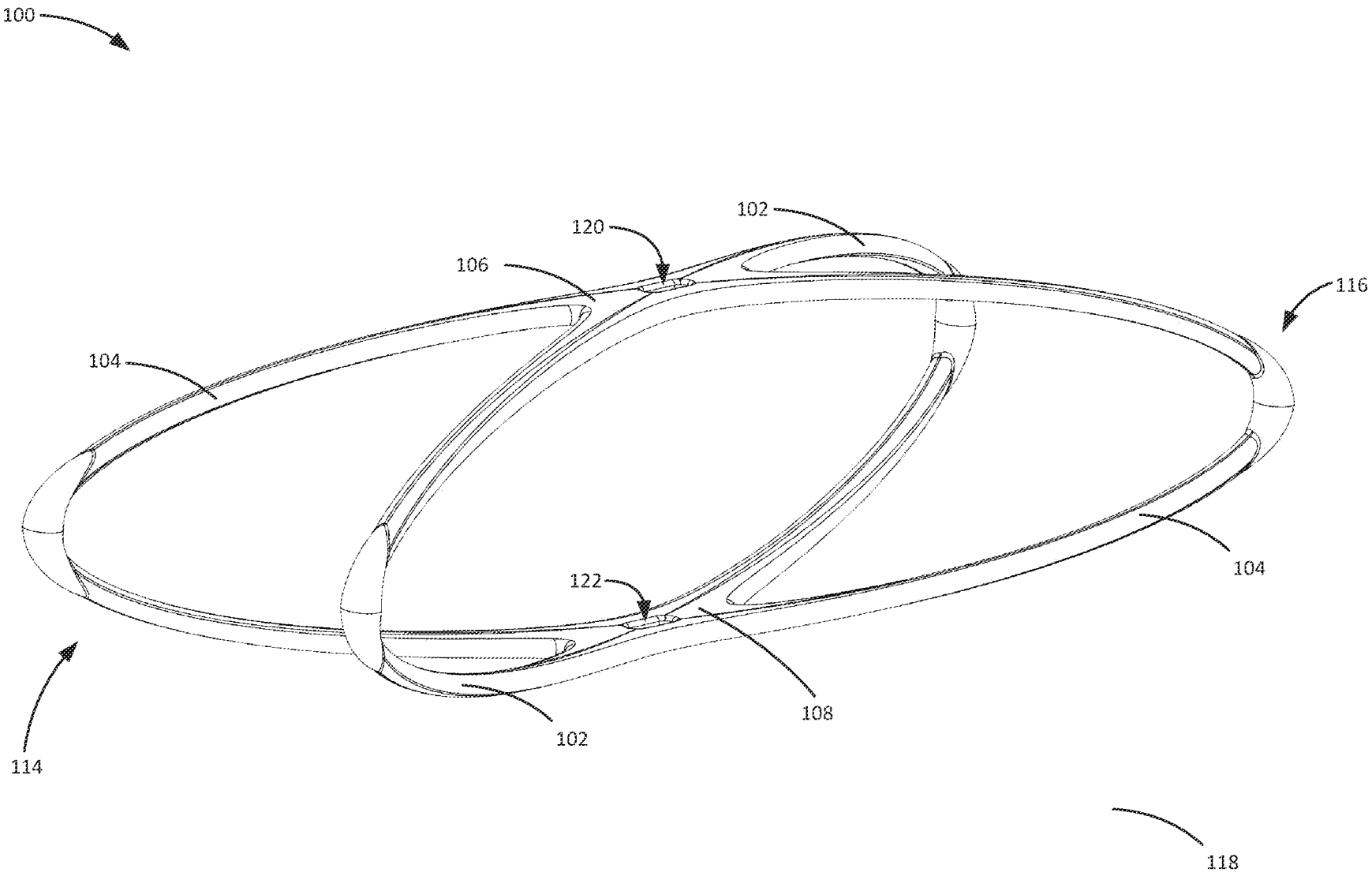
FIG. 6 is a perspective view of a flexible structure according to one embodiment.

Reference is now made to FIGS. 1-6. FIG. 1 is a perspective view of a flexible structure 100 according to one embodiment is shown. FIG. 2 is a top, plan view of the flexible structure 100 according to one embodiment. FIG. 3 is a side, elevation view of the flexible structure 100 according to one embodiment. FIG. 4 is a front, elevation view of the flexible structure 100 according to one embodiment. FIG. 5 is a bottom, perspective view of the flexible structure 100 according to one embodiment. FIG. 6 is a perspective view of a flexible structure 100 according to one embodiment. FIGS. 1-5 show a plane 118 conceptionally dividing the flexible structure 100 in half with a first portion and a second portion being symmetrical to each other.

Referring now to FIGS. 1-6, in an embodiment, a flexible structure 100 for collapsible flasks and bottles may include a first loop 102 and a second loop 104. The first loop 102 and second loop 104 are coupled to each other at a first intersection 106 and a second intersection 108. In an embodiment, the first intersection 106 and second intersection 108 may be formed into monolithic portions of the flexible structure 100 creating a single piece. This single piece may be formed using, for example, injection molding processes. The first intersection 106 and second intersection 108 in this embodiment are locations on the body of the flexible structure 100 where the first loop 102 and second loop 104 cross and are physically coupled to each other.

In some embodiments, the first loop 102 and second loop 104 may be coupled via an adhesive, rings, or any other coupling mechanism. In these embodiments, the arrangement of the first loop 102 relative to the second loop 104 may be adjustable so that the flexible structure 100 may accommodate for a larger range of different sizes or shapes of collapsible flasks.

The first loop 102 and second loop 104 may be elliptically shaped in an example embodiment. While an elliptical shape of the first loop 102 and second loop 104 is shown in FIGS. 1-6, it will be appreciated that other types of shapes may be used, such as circular, rectangular, or any other shape. This may allow for differently formed flexible structures 100 to be used in a variety of different shaped and sized collapsible flasks. In an embodiment, the shape of the first loop 102 and second loop 104 that form the flexible structure 100 will not interfere with water being poured into the flask or removed therefrom.

The flexible structure 100 may comprise a pliable material (e.g., plastic, carbon fiber, silicone) that may be elastically compressible so as to be positionable inside of a collapsible flask in an embodiment or positioned outside of a collapsible flask to act as an exoskeleton. The flexible structure 100 is still flexible so it can conform to the pocket, flask shape, and against the body of the user (e.g., a runner). In some embodiments, the flexible structure 100 may comprise a variety of different sizes and shapes to accommodate varying heights, widths, and shapes of the collapsible flasks. Additionally, the flexible structure 100 may comprise different sizes so as to address the various sized diameters of flask openings. In an embodiment, the angles at which the first loop 102 and second loop 104 of the flexible structure 100 engage with each other at the first intersection 106 and second intersection 108 may be adjustable so as to accommodate for the various heights, widths, diameters, or shapes of various types of the collapsible flasks. Again, this adjustability of the first loop 102 relative to the second loop 104 may be accomplished via a mechanical coupling of the first loop 102 to the second loop 104 at the first intersection 106 and second intersection 108 using, for example, an adhesive, rings, or any other coupling mechanism that allows for such adjustments to be made.

In some embodiments, the flexible structure 100 may be color coded to match a specific size and/or shape of a collapsible flask. For example, a red flexible structure may have a height of 5 inches, a green flexible structure may have a height of 6.5 inches, and a blue flexible structure may have a height of 7.5 inches. It will be appreciated that any color may relate to a specific height or shape of a flexible structure to assist a user in selecting a structure to fit their collapsible flask.

Figure 7:
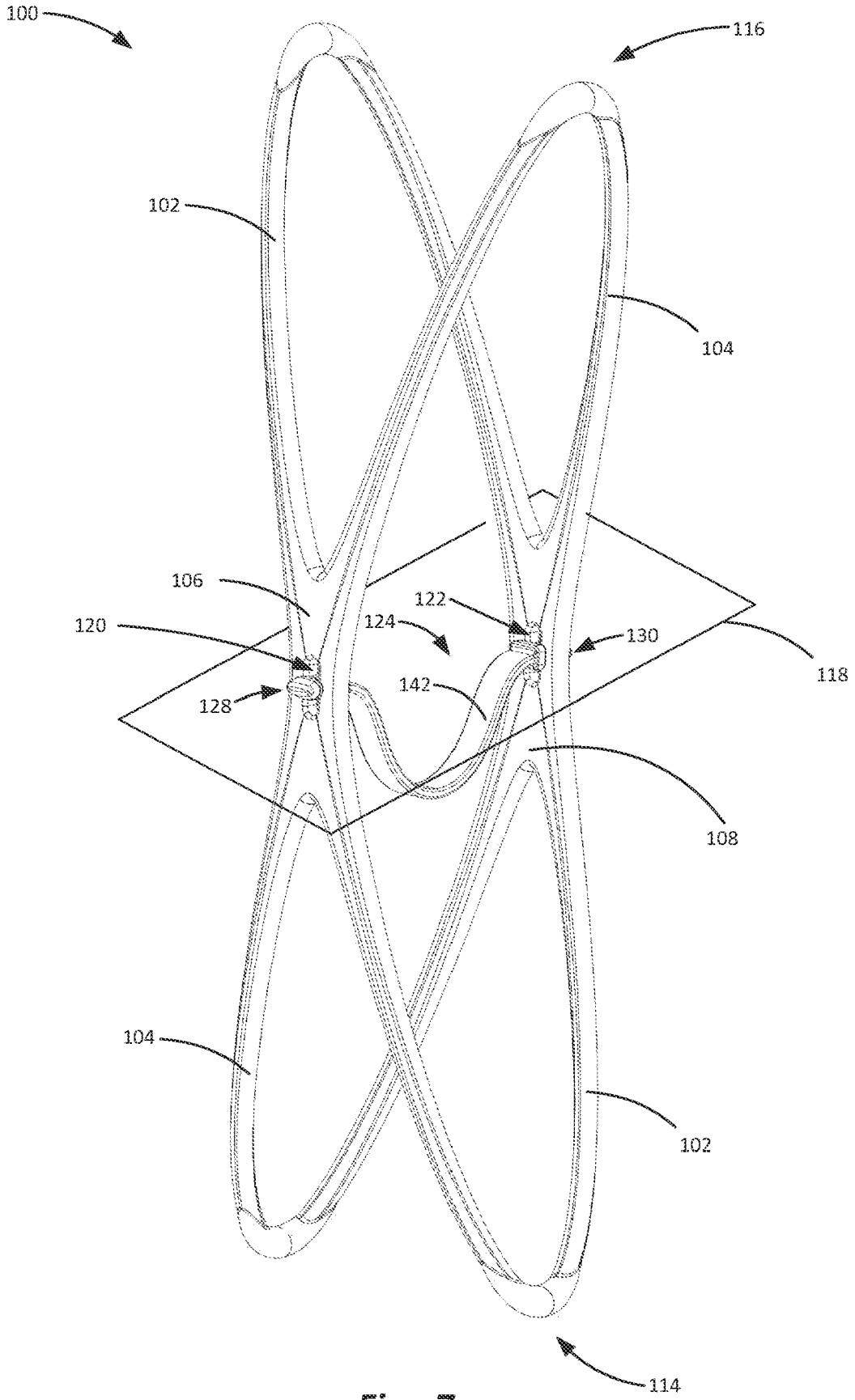
FIG. 7 is a perspective view of a flexible structure and a tether according to one embodiment.
Figure 8:
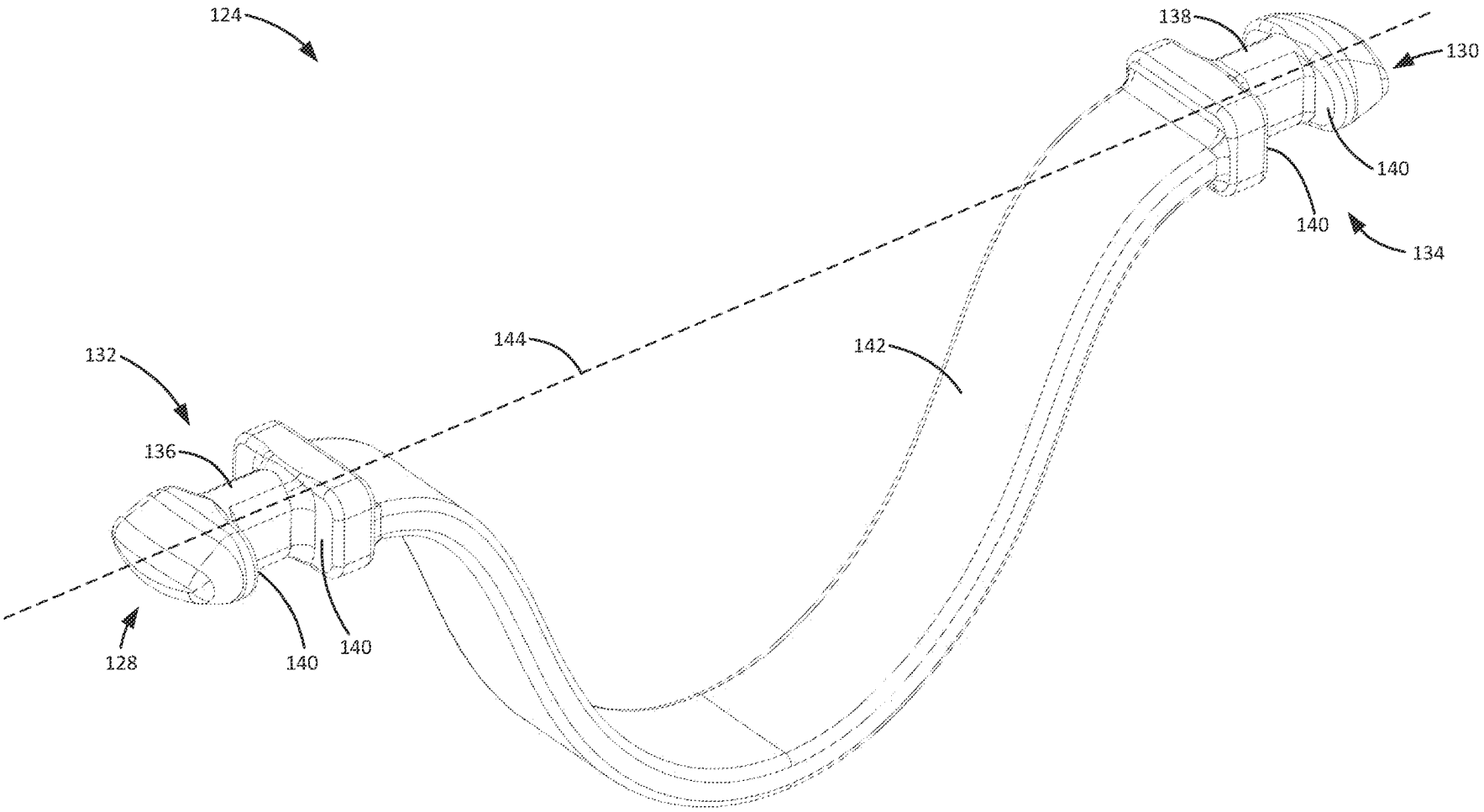
FIG. 8 is a perspective view of a tether of a flexible structure according to one embodiment.

FIGS. 1 and 4-6 also show a first tether connection socket 120 and a second tether connection socket 122. The first tether connection socket 120 may be formed through the first intersection 106 of the first loop 102 and second loop 104. The second tether connection socket 122 may be formed through the second intersection 108 of the first loop 102 and second loop 104. As described herein, a tether (not shown in FIGS. 1 and 4-6) may be placed to span between the first tether connection socket 120 and the second tether connection socket 122 to add support to the flexible structure 100 in addition to the first loop 102 and second loop 104. The tether 124 is shown in FIGS. 7 and 8 herein. It is appreciated that, in some embodiments, the tether operatively coupled to the flexible structure 100 may be permanently coupled to the flexible structure 100 at the first intersection 106 and second intersection 108. In another example embodiment, the tether may be removable from the flexible structure 100 to provide additional features to the flexible structure 100 as described herein.

FIG. 7 is a perspective view of a flexible structure 100 and a tether 124 according to another embodiment. As described herein, the flexible structure 100 includes a first loop 102 and second loop 104 that intersect with each other at a first intersection 106 and second intersection 108. Again, the first intersection 106 and second intersection 108 may be coupled together to form a monolithic flexible structure 100 in an embodiment. In another embodiment, the first intersection 106 and second intersection 108 may include an adhesive, rings, or any other coupling mechanism that allows the first loop 102 to be moved relative to the second loop 104 in order to use the flexible structure 100 with a variety of different sizes and shapes of collapsible flasks.

In the embodiment shown in FIG. 7, a first tether connection socket 120 is formed at the first intersection 106 while a second tether connection socket 122 is formed at the second intersection 108. The first tether connection socket 120 and the second tether connection socket 122 may include a channel formed through the first intersection 106 and second intersection 108, respectively. It is appreciated that in some example embodiments, however, the flexible structure 100 may not include the first tether connection socket 120, second tether connection socket 122, and the tether 124 that is coupled to the flexible structure 100. In this example embodiment where the flexible structure 100 does not include a tether 124 coupled to the flexible structure 100 via the first tether connection socket 120 and second tether connection socket 122, the flexible structure 100 may rely on the first loop 102 and second loop 104 to be used as the rigid structure that is placed within the collapsible flask as described herein.

In the example embodiment of FIG. 7 where the flexible structure 100 includes a tether 124 and, therefore a first tether connection socket 120 and second tether connection socket 122, the tether 124 may be used to provide additional structure to the flexible structure 100 in order to expand the walls of a collapsible flask and provide a relatively more rigid structure when placed within or coupled to the outside of the collapsible flask. In an embodiment, the user may or may not include the tether 124 assembled to the flexible structure 100 during use and the use of the tether 124 may depend on the desired rigidity of the collapsible flask and the presence (or not) of a first tether connection socket 120 and second tether connection socket 122 among other factors.

FIG. 8 is a perspective view of a tether of a flexible structure according to one embodiment. Turning to FIG. 8, the tether 124 may include a first tether end 128 and a second tether end 130. The first tether end 128 may interface mechanically with the first tether connection socket 120 to secure the first tether end 128 to the flexible structure 100 at the first intersection 106. The second tether end 130 may interface mechanically with the second tether connection socket 122 to secure the second tether end 130 to the flexible structure 100 at the second intersection 108. In an embodiment, the first tether end 128 and second tether end 130 may include mechanical structures such as a first joint well, second joint well, and locking walls to secure the first tether end 128 and second tether end 130 of the tether 124 to the flexible structure 100 when assembled. The first joint well, the second joint well, and the locking walls are described in more detail in connection with FIG. 8.

The tether 124 also includes a tether strap 142 connecting the first tether end 128 and second tether end 130 to each other. As shown in FIG. 7, the tether 124 may include a bendable shape that allows the flexible structure 100 to be compressed such that the first intersection 106 and second intersection 108 are drawn together. In an embodiment, the tether strap 142 may be made of an elastically bendable material similar to the material used to form the flexible structure 100. This elastically bendable material may be temporarily bent under a force. When this force is released, the material may return to its pre-bent shape. In an embodiment, the tether 124 may be made of plastic, carbon fiber, silicone, for example. In an embodiment, the flexible structure 100 may be elastically bent in order to pass the flexible structure 100 through an opening in a collapsible flask. As this occurs, the tether 124 may also be elastically bent. Again, when the force used to bend the flexible structure 100 and the tether 124 is released when the flexible structure 100 is placed within the interior of the collapsible flask, the expansion of the flexible structure 100 and tether 124 (e.g., due to the elastic return to their original shape), the collapsible flask may be expanded and the flexible structure 100 and tether 124 may provide a level of rigidity within the internal structure of the collapsible flask.

FIG. 8 is a perspective view of a tether 124 of a flexible structure 100 according to one embodiment. As described herein, the tether 124 includes a first tether end 128 and a second tether end 130. The first tether end 128 and second tether end 130 may interface, mechanically, with the flexible structure (e.g., flexible structure 100, FIG. 7) at the first tether connection socket and second tether connection socket.

Again, the first tether end 128 and second tether end 130 may be operatively coupled to each other via a tether strap 142. The tether 124 may include a bendable shape that allows the flexible structure 100 to be compressed such that the first intersection 106 and second intersection 108 are drawn together thereby elastically bending the tether 124 at the tether strap 142. The tether strap 142 may be made of an elastically bendable material to allow for the bent tether 124 to return to its original shape. This elastically bendable material may be temporarily bent under a force by a user. However, when the force is released, the material may return to its pre-bent shape thereby expanding the distance between the first intersection 106 and second intersection 108 of the flexible structure 100. In an embodiment, the tether 124 may be made of the same or similar material as the first loop 102 and second loop 104 of the flexible structure 100.

The mechanical interface 132 between the tether 124 and the first tether connection socket 120 and second tether connection socket 122 may include a first joint well 136 at the first tether end 128 and a second joint well 138 at the second tether end 130, respectively, as well as one or more locking walls 140. In an example embodiment, the first tether end 128 includes a first joint well 136 between locking walls 140. The terminal end of the first tether end 128 may include an oval-shaped locking wall 140 that, when the tether 124 is rotated about axis 144 ninety degrees, the terminal end of the first tether end 128 may pass through the first tether connection socket 120 formed through the first intersection. In this embodiment, the first tether connection socket may also be oval shaped to receive the oval-shaped first tether end 128. When the tether 124 is rotated ninety degrees back to the orientation shown in FIG. 8, the oval shape of the terminal end of the first tether end 128 prevents the tether 124 from being separated from the flexible structure. The first tether end 128 also includes a locking wall 140 opposite the oval-shaped terminal end that prevents the tether 124 from passing further through the first tether connection socket such that the locking walls 140 sandwich the first intersection between the locking walls 140 when the tether 124 is installed on the flexible structure 100.

Similarly, in an example embodiment, the second tether end 130 includes a mechanical interface 134 with a second joint well 138 between locking walls 140. The terminal end of the second tether end 130 may include an oval-shaped locking wall 140 that, when the tether 124 is rotated about axis 144 ninety degrees, the terminal end of the second tether end 130 may pass through the second tether connection socket formed through the second intersection. When the tether 124 is rotated ninety degrees back to the orientation shown in FIG. 8, the oval shape of the terminal end of the second tether end 130 prevents the tether 124 from being separated from the flexible structure. The second tether end 130 also includes a locking wall 140 opposite the oval-shaped terminal end that prevents the tether 124 from passing further through the second tether connection socket such that the locking walls 140 sandwich the second intersection between the locking walls 140. In an embodiment, the fit between the first tether end 128 and the first tether connection socket and the second tether end and the second tether connection socket 122, respectively, is an interference fit such that the rotation of the tether 124 about the axis 144 is relatively difficult. In this embodiment, a user must purposefully apply sufficient force on the tether 124 to rotate the tether 124 about the axis 144 and uncouple the tether 124 from the flexible structure 100 at the first tether connection socket 120 and second tether connection socket 122.

Figure 9:
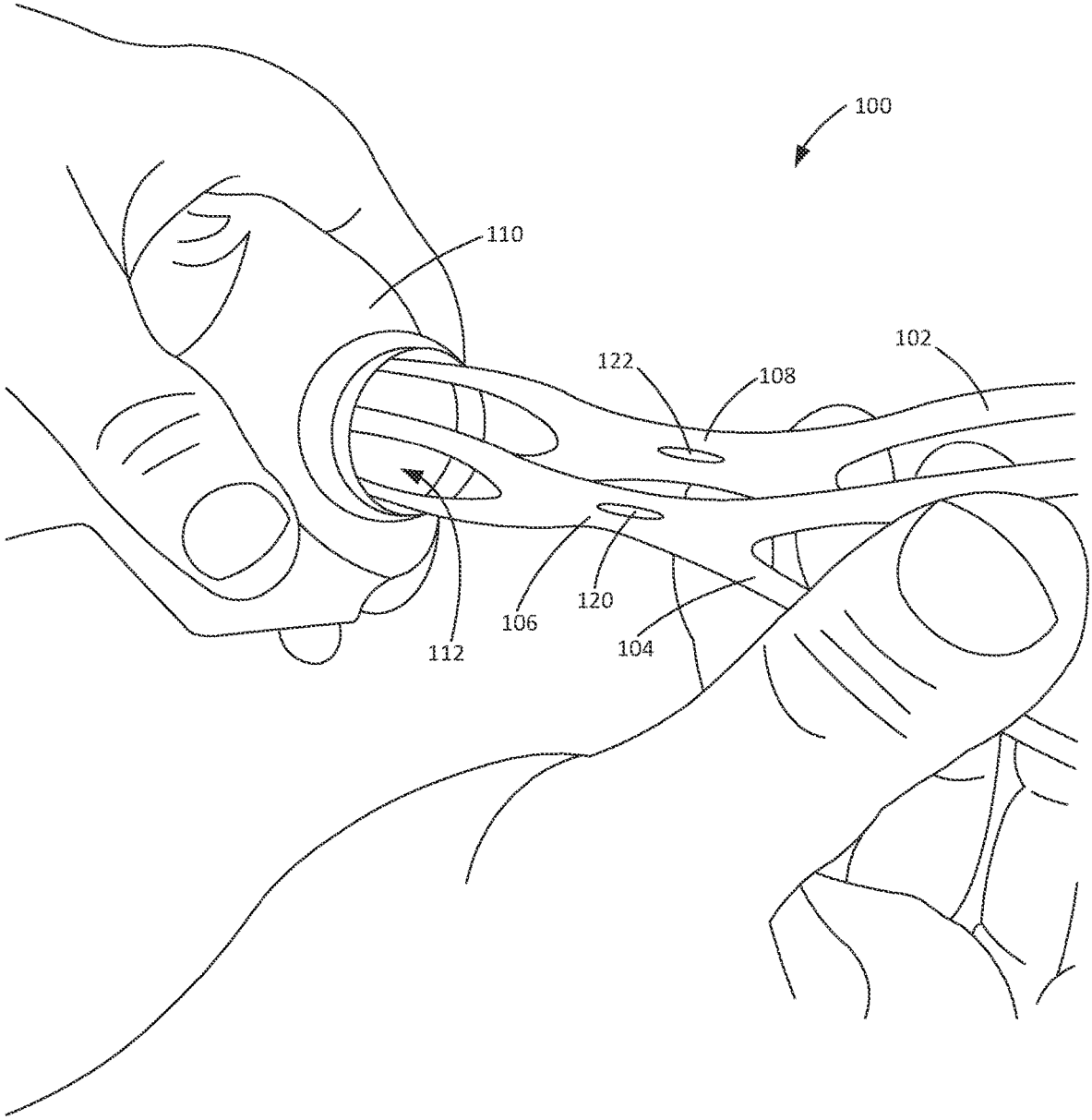
FIG. 9 is a perspective view of a flexible structure being inserted into a flask according to one embodiment.
Figure 10:
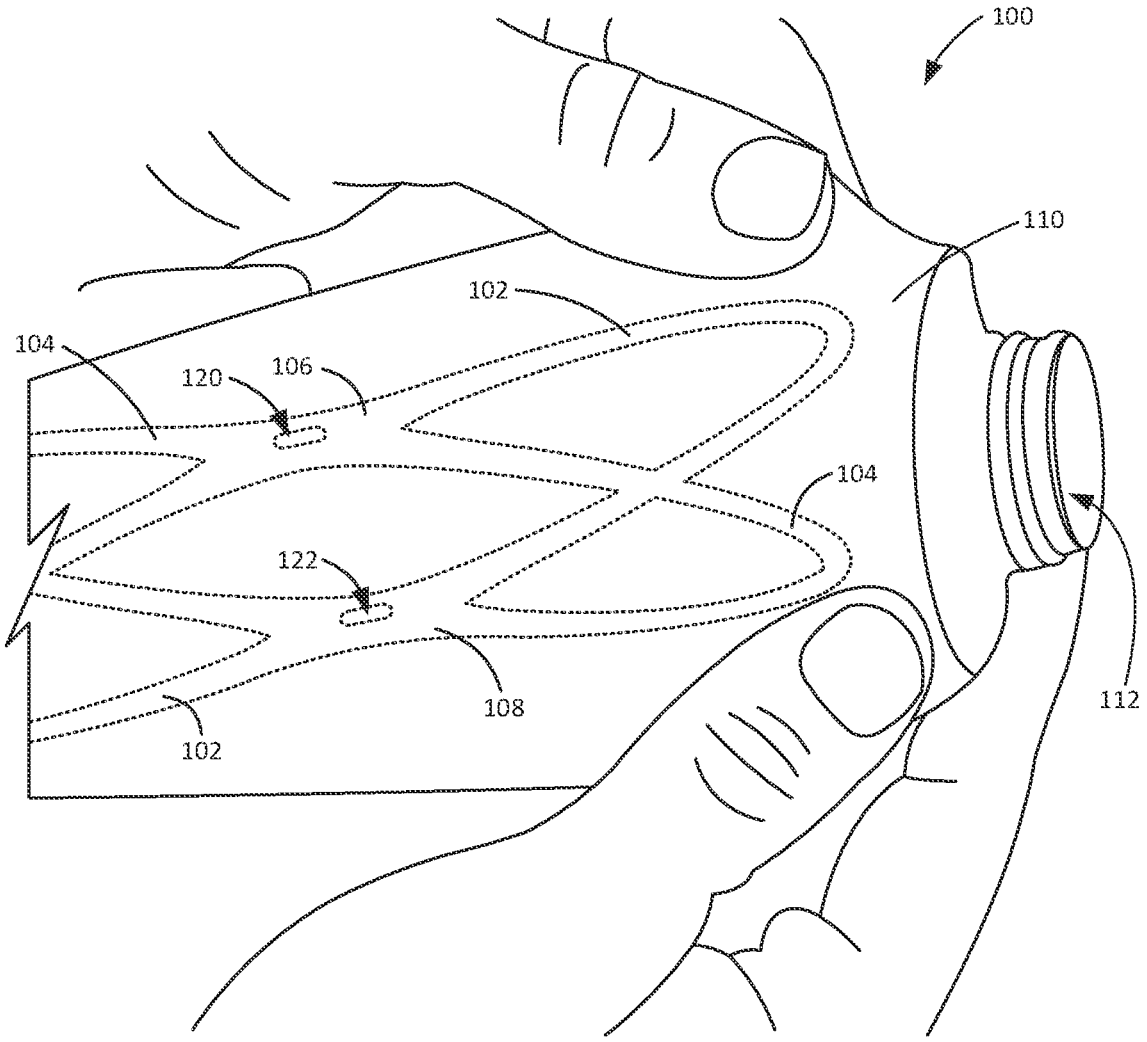
FIG. 10 is a side perspective view of a flask with a flexible structure inserted therein according to one embodiment.

FIGS. 9 and 10 illustrate the flexible structure 100 being positioned into a variety of different sized flasks. FIG. 9 is a perspective view of a flexible structure being inserted into a flask according to one embodiment. FIG. 10 is a side perspective view of a flask with a flexible structure inserted therein according to one embodiment. These figures will now be referenced to in order to describe the installation of the flexible structure 100 into a collapsible flask 110.

To insert the flexible structure 100 into a flask 110, a user may compress or squeeze the flexible structure 100, decreasing the diameter of the flexible structure 100 in, at least, one dimension, and inserting it into an opening 112 and into the soft, collapsible flask 110. In an embodiment, a user may insert a first end (e.g., 114, FIGS. 1 and 3-7) of the flexible structure 100 into the opening 112 of the collapsible flask 110 and then continue pushing the structure into the collapsible flask 110. Once a second end (e.g., 116, FIGS. 1 and 3-7) of the structure 100 enters the collapsible flask 110, the flexible structure 100 may expand and conform to an interior shape of the collapsible flask 110. The flexible structure 100 may expand the collapsible flask 110 and provide a level of rigidity to the collapsible flask 110 so that a user may insert it into a race vest pocket or any other pocket, without it deforming or losing its shape. It will be appreciated that when a user needs to store or clean the flask, they may grasp and compress the second end of the flexible structure 100 in the flask 110 and remove it therefrom to be cleaned, stored, or placed in a different flask.

It is appreciated that the flexible structure 100 shown in FIGS. 9 and 10 may include a first tether connection socket 120 and a second tether connection socket 122 to receive a first tether end (e.g., 128, FIGS. 7 and 8) and a second tether end (e.g., 130, FIGS. 7 and 8), respectively, of a tether (e.g., tether 124, FIGS. 7 and 8). As described herein, the pliability of the collapsible flask 110 may be sufficient such that inclusion of the tether with the flexible structure 100 would provide additional expansion of the collapsible flask 110 and a relatively higher amount of rigidity with the collapsible flask 110. However, a user may decide, as shown in FIGS. 9 and 10, to not include the tether device with the collapsible flask 110. As such the tether may be an optional support structure to be used at the user's discretion.

It is appreciated that, in order to remove the flexible structure 100 from within the collapsible flask 110, the process may be different. For example, a user may access the flexible structure 100 via the collapsible flask opening 112 and simply pull the flexible structure 100 from within the collapsible flask 110. The sidewalls of the collapsible flask opening 112 may cause the flexible structure 100 to bend inward as shown in FIG. 9 allowing the user to remove the flexible structure 100 in an example embodiment. In another embodiment, the user may initially bend the flexible structure 100 from outside of the collapsible flask 110 by pressing inward on the sides of the collapsible flask 110 thereby bending the flexible structure 100 into a shape similar to that shown in FIG. 9 while the flexible structure 100 is inside the collapsible flask 110. Once elastically bent, the flexible structure 100 may be pulled out from within the collapsible flask 110 by the user while the user maintains the force sufficient to elastically bend the flexible structure 100. Once removed, the user may release the force exerted on the flexible structure 100 to bend it thereby allowing the flexible structure 100 to return to its pre-deformed state.

Figure 11:
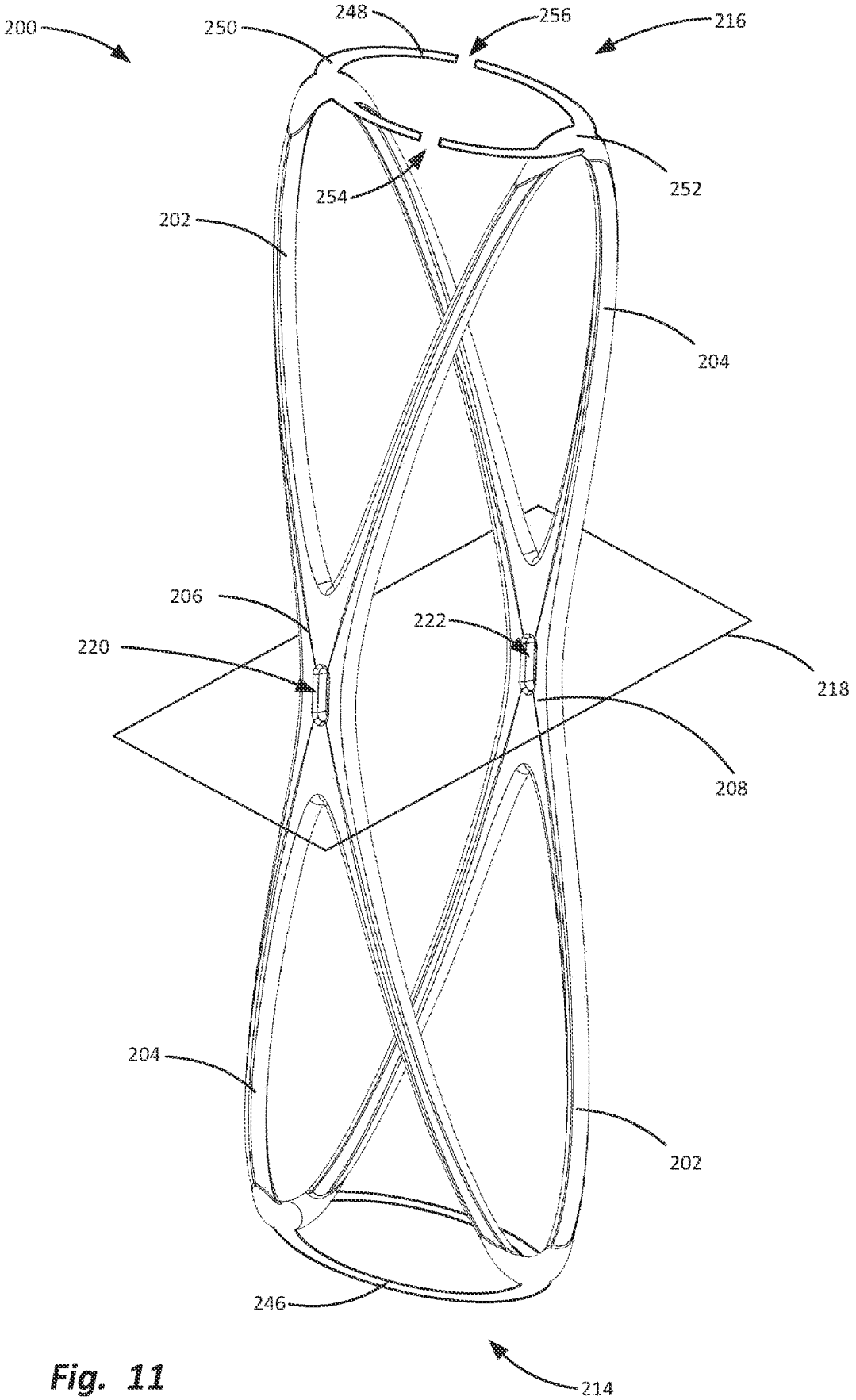
FIG. 11 is a perspective view of a flexible structure according to another embodiment.
Figure 12:
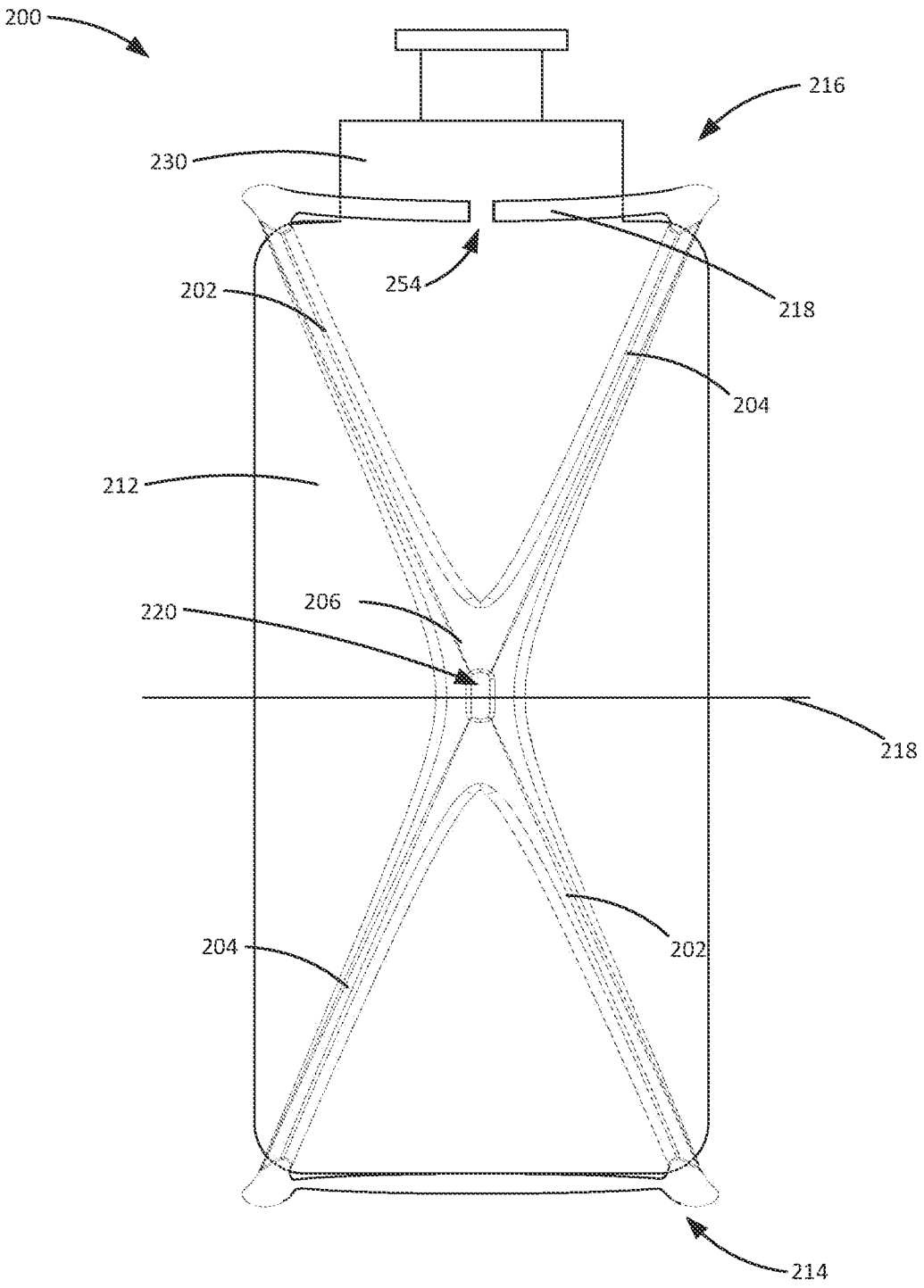
FIG. 12 is a front elevation view of a flexible structure coupled to an outer surface of a flask according to one embodiment.

In an embodiment, as shown in FIGS. 11 and 12, a flexible structure 200 for collapsible flasks and bottles may include a first loop 202 and a second loop 204 used to expand a collapsible flask 212 and provide a level of rigidity for the collapsible flask 212. FIG. 11 is a perspective view of a flexible structure 200 according to another embodiment and FIG. 12 is a front elevation view of a flexible structure 200 coupled to an outer surface of a collapsible flask 212 according to an embodiment. Again, a plane 218 is shown in FIGS. 11 and 12 conceptionally dividing the flexible structure 200 in half with a first portion and a second portion being symmetrical to each other.

The first loop 202 and second loop 204 are coupled to each other at a first intersection 206 and a second intersection 208. The first intersection 206 and second intersection 208 may each be a single body molded via the manufacturing process, at locations where the first intersection 206 and second intersection 208 cross. This single piece may be formed using, for example, injection molding processes. The first intersection 206 and second intersection 208 in this embodiment are locations on the body of the flexible structure 200 where the first loop 202 and second loop 204 cross and are physically coupled to each other.

In some embodiments, the first loop 202 and second loop 204 may be coupled via an adhesive, rings, or any other coupling mechanism. In these embodiments, the arrangement of the first loop 202 relative to the second loop 204 may be adjustable so that the flexible structure 200 may accommodate for a larger range of different sizes or shapes of collapsible flasks 212. The first loop 202 and second loop 204, as descried herein, may be elliptically shaped or any other shape as discussed above with regard to a flexible structure (e.g., 100, FIGS. 1-7).

A first end 214 of the flexible structure 200 may comprise a first ring 246 coupled at a bottom portion of the flexible structure 200 at a first end of the flexible structure 200. More specifically, the first ring 246 may be perpendicular and coupled to the first loop 202 and the second loop 204. The first ring 246 may contact a bottom portion of a flask 212 or bottle.

In addition, the flexible structure 200 may include a second ring 248 at a second end 216 coupled at a top portion of the flexible structure 200 opposite the first end 214 of the flexible structure 200. The second ring 248 may be interposed between the first loop 202 and second loop 204, similar to the first ring 246. The second ring 248 may comprise a first side 250 and a second side 252 separated by a first gap 254 and a second gap 256. It will be appreciated that the first gap 254 and second gap 256 allow the second ring 248 to be placed around the collapsible flask 212 and be positioned on a neck 230 of the collapsible flask 212. The flexible structure 200 may comprise a pliable material (e.g., plastic) that may be flexible so that it may expand around the collapsible flask 212 or bottle. The flexible structure 200 may act as an exoskeleton to add a rigidity to the collapsible flask 212 as well as cause the collapsible flask 212 to expand.

As described herein, the flexible structure 200 may include a first tether connection socket 220 formed at a first intersection 206 of the flexible structure 200 to receive a first end of a tether (e.g., 124, FIG. 8). Similarly, the flexible structure 200 may include a second tether connection socket 222 formed at a second intersection 208 of the flexible structure 200 to receive a second end of a tether (e.g., 124, FIG. 8). However, because, in the example embodiments shown in FIGS. 11 and 12, the flexible structure 200 is to be placed on an outside surface of the collapsible flask 212, the tether may be removed and stored for later user. This allows the flexible structure 200 to be used either interior to the collapsible flask 212 or exterior to the collapsible flask 212 providing additional variability to the use of the flexible structure 200. Indeed, when the flexible structure 200 shown in FIGS. 11 and 12 is used internal to the collapsible flask 212, the user may manipulate the flexible structure 200 similar to the flexible structure 100 shown in FIGS. 9 and 10 in order to place the flexible structure 200 within the collapsible flask 212.

In an embodiment, the flexible structure 200 may be positioned around an outside neck of the collapsible flask 212 (between a lid and the neck 230 of the collapsible flask 212). The flexible structure 200 may extend to a bottom of the collapsible flask 212 and couple thereto so as to add some rigidity to the collapsible flask 212 as well as expand the collapsible flask 212 from the exterior surface of the collapsible flask 212. In some embodiments, a hook or clip may be used to couple the flexible structure 200 to the bottom of the collapsible flask 212.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this disclosure.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, Figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. § 112 Para. 6. It will be apparent to those having skill in the art that changes may be made to the details of the above-described embodiments without departing from the underlying principles of the disclosure.

While specific embodiments and applications of the present disclosure have been illustrated and described, it is to be understood that the disclosure is not limited to the precise configuration and components disclosed herein. Various modifications, changes, and variations which will be apparent to those skilled in the art may be made in the arrangement, operation, and details of the methods and systems of the present disclosure set forth herein without departing from the spirit and scope of the claims.

What is claimed is:

1. A flexible structure system configured to expand a collapsible flask, the flexible structure system comprising:

a flexible structure comprising:

a first loop made of an elastically flexible material comprising:

a first loop top portion; and a first loop bottom portion; and a second loop made of an elastically flexible material comprising:

a second loop top portion; and a second loop bottom portion;

wherein:

the first loop and the second loop are operatively coupled together at a first intersection and a second intersection;

the first loop and the second loop, together, are elastically movable between a compressed configuration in which the first loop and the second loop are sufficiently narrow to fit through an opening of the collapsible flask, and an expanded configuration in which the first loop and the second loop are not sufficiently narrow to fit through the opening;

the first loop top portion and the second loop top portion are configured, with the flexible structure in the collapsible flask, to engage and expand a top portion of the collapsible flask; and the first loop bottom portion and the second loop bottom portion are configured, with the flexible structure in the collapsible flask, to engage and expand a bottom portion of the collapsible flask.

2. The flexible structure system of claim 1 further comprising:

a tether comprising a first end mechanically coupled to the flexible structure and a second end mechanically coupled to the flexible structure.

3. The flexible structure system of claim 2, wherein:

the first end of the tether is coupled to the flexible structure at a first tether connection socket formed at the first intersection of the first loop and the second loop; and the second end of the tether is coupled to the flexible structure at a second tether connection socket formed at the second intersection of the first loop and the second loop.

4. The flexible structure system of claim 2, wherein the tether further comprises:

a first tether joint formed at the first end of the tether, the first tether joint including:

a first joint well;

a first locking wall formed on a first side of the first joint well, the first locking wall having an oval shape; and a second locking wall formed on a second side of the first joint well;

wherein the first locking wall interfaces with a first tether connection socket formed at the first intersection of the first loop and the second loop to allow the first locking wall to pass through the first tether connection socket when the tether is in a first orientation and lock the tether against the first intersection when the tether is in a second orientation.

5. The flexible structure system of claim 2, wherein the tether further comprises:

a second tether joint formed at the second end of the tether, the second tether joint including:

a second joint well;

a first locking wall formed on a first side of the second joint well, the first locking wall having an oval shape; and a second locking wall formed on a second side of the second joint well;

wherein the first locking wall interfaces with a second tether connection socket formed at the second intersection of the first loop and the second loop to allow the first locking wall to pass through the second tether connection socket when the tether is in a first orientation and lock the tether against the second intersection when the tether is in a second orientation.

6. The flexible structure system of claim 1 further comprising:

a first ring formed perpendicular to and coupled to the first loop bottom portion and the second loop bottom portion.

7. The flexible structure system of claim 1 further comprising:

a second ring formed perpendicular to and coupled to the first loop top portion and the second loop top portion, the second ring including:

a first side coupled to the first loop top portion;

a second side coupled to the second loop top portion;

a first gap separating the first side from the second side; and a second gap separating the first side from the second side;

wherein the second ring is sized to fit around a neck of the collapsible flask.

8. The flexible structure system of claim 1 wherein:

the first loop comprises a first elongate shape; and the second loop comprises a second elongate shape.

9. The flexible structure system of claim 8 wherein:

the first loop comprises a first elliptical shape; and the second loop comprises a second elliptical shape.

10. The flexible structure system of claim 1 further comprising the collapsible flask.

11. A flexible structure configured to expand a collapsible flask, the flexible structure comprising:

a first loop made of an elastically flexible material;

a second loop made of an elastically flexible material;

a first intersection of the first loop and the second loop at which the first loop and the second loop are formed as a first single piece; and a second intersection of the first loop and the second loop at which the first loop and the second loop are formed as a second single piece;

wherein the first loop and the second loop, together, are elastically movable between a compressed configuration in which the first loop and the second loop are sufficiently narrow to fit through an opening of the collapsible flask, and an expanded configuration in which the first loop and the second loop are not sufficiently narrow to fit through the opening.

12. The flexible structure of claim 11, wherein:

the flexible structure further comprises a tether having a first end and a second end;

the first end of the tether is coupled to the flexible structure at the first intersection of the first loop and the second loop;

the second end of the tether is coupled to the flexible structure at the second intersection of the first loop and the second loop; and the first loop and the second loop, together, are elastically movable between the compressed configuration in which the tether is slack, and the expanded configuration in which the tether is tensioned to limit expansion of the first loop and the second loop.

13. The flexible structure of claim 12, wherein the tether further comprises:

a first tether joint formed at the first end of the tether, the first tether joint including:

a first joint well;

a first locking wall formed on a first side of the first joint well, the first locking wall having an oval shape; and a second locking wall formed on a second side of the first joint well;

wherein the first locking wall interfaces with a first tether connection socket formed at the first intersection of the first loop and the second loop to allow the first locking wall to pass through the first tether connection socket when the tether is in a first orientation and lock the tether against the first intersection when the tether is in a second orientation.

14. The flexible structure of claim 12, wherein the tether further comprises:

a second tether joint formed at the second end of the tether, the second tether joint including:

a second joint well;

a first locking wall formed on a first side of the second joint well, the first locking wall having an oval shape; and a second locking wall formed on a second side of the second joint well;

wherein the first locking wall interfaces with a second tether connection socket formed at the second intersection of the first loop and the second loop to allow the first locking wall to pass through the second tether connection socket when the tether is in a first orientation and lock the tether against the second intersection when the tether is in a second orientation.

15. The flexible structure of claim 11 further comprising:

a first ring formed perpendicular to and coupled to the first loop and the second loop at a bottom portion of the flexible structure.

16. The flexible structure of claim 11 further comprising:

a second ring formed perpendicular to and coupled to the first loop and the second loop at a top portion of the flexible structure, the second ring including:

a first side coupled to the first loop;

a second side coupled to the second loop;

a first gap separating the first side from the second side; and a second gap separating the first side from the second side;

wherein the second ring is sized to fit around a neck of the collapsible flask.

17. The flexible structure of claim 11, wherein the first loop and the second loop are formed at a predetermined angle relative to each other at the first intersection and the second intersection.

18. A flexible structure configured to expand a collapsible flask, the flexible structure comprising:

a first loop made of an elastically flexible material;

a second loop made of an elastically flexible material; and a tether;

wherein:

the first loop and the second loop are operatively coupled together at a first intersection and second intersection;

the tether comprises:

a first end coupled to the first loop and the second loop at the first intersection; and a second end coupled to the first loop and the second loop at the second intersection; and the first loop and the second loop, together, are elastically movable between a compressed configuration in which the tether is slack and the first loop and the second loop are sufficiently narrow to fit through an opening of the collapsible flask, and an expanded configuration in which the tether is tensioned and the first loop and the second loop are not sufficiently narrow to fit through the opening.

19. The flexible structure of claim 18, wherein the tether further comprises:

a first tether joint formed at the first end of the tether, the first tether joint including:

a first joint well;

a first locking wall formed on a first side of the first joint well, the first locking wall having an oval shape; and a second locking wall formed on a second side of the first joint well;

wherein the first locking wall interfaces with a first tether connection socket formed at a first intersection of the first loop and the second loop to allow the first locking wall to pass through the first tether connection socket when the tether is in a first orientation and lock the tether against the first intersection when the tether is in a second orientation.

20. The flexible structure of claim 18, wherein the tether further comprises:

a second tether joint formed at a second end of the tether, the second tether joint including:

a second joint well;

a first locking wall formed on a first side of the second joint well, the first locking wall having an oval shape; and a second locking wall formed on a second side of the second joint well;

wherein the first locking wall interfaces with a second tether connection socket formed at a second intersection of the first loop and the second loop to allow the first locking wall to pass through the second tether connection socket when the tether is in a first orientation and lock the tether against the second intersection when the tether is in a second orientation.

21. The flexible structure of claim 18 further comprising:

a first ring formed perpendicular to and coupled to the first loop and second loop at a bottom portion of the flexible structure.

22. The flexible structure of claim 18 further comprising:

a second ring formed perpendicular to and coupled to the first loop and second loop at a top portion of the flexible structure, the second ring including:

a first side coupled to the first loop;

a second side coupled to the second loop;

a first gap separating the first side from the second side; and a second gap separating the first side from the second side;

wherein the second ring is sized to fit around a neck of a collapsible flask.

* * * * *